US011930906B2

(12) United States Patent
Boyle et al.

(10) Patent No.: US 11,930,906 B2
(45) Date of Patent: Mar. 19, 2024

(54) CRAFTING SCRAP COLLECTION AND NAIL POLISH HOLDER DEVICES AND METHODS OF USE THEREOF

(71) Applicant: Juka Innovations Corporation, Farmingdale, NY (US)

(72) Inventors: Elizabeth Boyle, Sullivans Island, SC (US); Mark Miclette, Sullivans Island, SC (US)

(73) Assignee: JUKA INNOVATIONS CORPORATION, Farmingdale, NY (US)

( * ) Notice: Subject to any disclaimer, the term of this patent is extended or adjusted under 35 U.S.C. 154(b) by 26 days.

(21) Appl. No.: 17/552,970

(22) Filed: Dec. 16, 2021

(65) Prior Publication Data

US 2023/0189960 A1 Jun. 22, 2023

(51) Int. Cl.
*A45D 29/11* (2006.01)
*A45D 29/18* (2006.01)

(52) U.S. Cl.
CPC ..... *A45D 29/11* (2013.01); *A45D 29/18* (2013.01)

(58) Field of Classification Search
CPC ..... A45D 29/11; A45D 29/18; F16M 11/14; B60R 2011/0085; B60R 2011/0056
See application file for complete search history.

(56) References Cited

U.S. PATENT DOCUMENTS 2,471,512 A * 5/1949 Barlock ..... A45D 34/00 248/141
2,659,920 A * 11/1953 Bogan ..... A45D 34/00 248/346.03
5,141,188 A * 8/1992 DeBlasi ..... A45D 34/00 248/142
5,649,256 A * 7/1997 Wen ..... F16M 11/14 396/428
7,021,593 B1 * 4/2006 Fan ..... F16B 47/00 248/292.12
7,303,171 B1 * 12/2007 Chen ..... B60R 11/02 396/419
8,025,169 B2 9/2011 Zimmerman
8,028,850 B2 10/2011 Zimmerman
(Continued)

FOREIGN PATENT DOCUMENTS

DE 202010009954 * 2/2010
JP 201842959 * 3/2018

OTHER PUBLICATIONS

Ivyne crafting, retrieved from the internet, retrieved on Dec. 8, 2022; <URL: https://www.amazon.com/stores/iVyne/page/23A54882-C7C3-464D-9199-44F7564AFDBC?ref_=ast_bln>.
(Continued)

*Primary Examiner* — Nicholas D Lucchesi
*Assistant Examiner* — Jennifer Gill

(57) ABSTRACT

Provided for are devices having a crown with an opening defining an access to a cavity of the crown for the insertion of nail polish containers or crafting scrap materials, such as waste produced in vinyl weeding. Advantageously, the devices are anchorable for directional release and attachment to a surface. The crown may be hingedly positionable with respect to a vented suction base anchorable to a surface. Further provided for are methods of use of devices in the application of nail polish or in crafting, such as in vinyl weeding.

3 Claims, 15 Drawing Sheets

(56) References Cited

U.S. PATENT DOCUMENTS

| | | | | |
|---|---|---|---|---|
| 8,757,418 | B2 | 6/2014 | Zimmerman et al. | |
| 9,585,455 | B2 | 3/2017 | Boyle et al. | |
| 9,814,332 | B2 | 11/2017 | Zimmerman et al. | |
| 2007/0138358 | A1* | 6/2007 | Chang | F16C 11/106 248/205.5 |
| 2007/0200037 | A1* | 8/2007 | Nan | A61H 19/44 248/205.5 |
| 2009/0294608 | A1* | 12/2009 | Brassard | F16B 47/00 248/205.5 |
| 2016/0037762 | A1* | 2/2016 | Thomas | A01K 97/10 248/515 |
| 2016/0295986 | A1* | 10/2016 | Boyle | A44C 9/0061 |
| 2019/0191686 | A1* | 6/2019 | Thomas | A01K 97/10 |
| 2021/0229904 | A1* | 7/2021 | Krieg | B65F 1/141 |

OTHER PUBLICATIONS

IVyne Berry Suctioned Vinyl Weeding Scrap Collector & Holder for Weeding Tools for Vinyl—Green, retrieved from the internet, retrieved on Dec. 8, 2022; <URL:https://www.amazon.com/iVyne-Berry-Suctioned-Weeding-Collector/dp/B08FNJRFKY?ref_=ast_sto_dp&th=1&psc=1>.

IVyne (8pcs) Premium Vinyl Weeding Tool Kit & Weeding Scrap Collector Soft Grip Tools with Berry, Weeder, Tweezers, Picker Or Hook, and Scraper Set for Silhouette Cameos & Cricut—Purple, retrieved from the internet, retrieved on Dec. 8, 2022; <URL: https://www.amazon.com/iVyne-Premium-Collector-Tweezers-Silhouette/dp/B0BG87XLX9?ref_=ast_sto_dp&th=1&psc=1>.

IVyne Berry and Silicone Weeding Tools for Vinyl, Suction Vinyl Weeding Scrap Collector Holder, Craft Tweezer, Weeder, Vinyl Weeding Tool Kit for Cricut, Silhouette Accessories Scrap Storage—Pink, retrieved from the internet, retrieved on Dec. 8, 2022; <URL: https://www.amazon.com/iVyne-Silicone-Collector-Silhouette-Accessories/dp/B08S6L8175?ref_=ast_sto_dp&th=1&psc=1>.

IVyne Complete Set Rechargeable A7 Light Pad, Weeding Tools for Vinyl, Weeding Scrap Collector for Cricut and Silhouette Machines for Weeding, Tracing, Drawing Projects—Blue, retrieved from the internet, retrieved on Dec. 8, 2022; <URL: https://www.amazon.com/iVyne-Complete-Rechargeable-Collector-Silhouette/dp/B09C6P6PWZ?ref_=ast_sto_dp&th=1&psc=1>.

IVyne White Heat Transfer Vinyl—12" x 25ft PU Iron On Vinyl for Cricut & Silhouette Cameo—HTV Roll Easy to Cut & Weed for T Shirts, Caps & Other Crafting Applications, retrieved from the internet, retrieved on Dec. 8, 2022; <URL: https://www.amazon.com/iVyne-White-Heat-Transfer-Vinyl/dp/B0BDS19SMH?ref_=ast_sto_dp&th=1&psc=1>.

* cited by examiner

CRAFTING SCRAP COLLECTION AND NAIL POLISH HOLDER DEVICES AND METHODS OF USE THEREOF

TECHNICAL FIELD

Provided for are devices having a crown with an opening defining an access to a cavity of the crown for the insertion of nail polish containers or crafting scrap materials, such as waste produced in vinyl weeding. Advantageously, the devices are anchorable for directional release and attachment to a surface. The crown may be hingedly positionable with respect to a vented suction base anchorable to a surface. Further provided for are methods of use of devices in the application of nail polish or in crafting, such as in vinyl weeding.

BACKGROUND

Certain activities rely upon using the hand, or an instrument held therein, to interact with a stationary item on a work surface. For example, the application of nail polish requires the user to precisely place a brush applicator within a narrow aperture of a nail polish bottle in order to coat the applicator and then apply the polish to the nails. One solution is to hold the nail polish bottle within a holder device fitting around the user's fingers. Such a device is generally disclosed in U.S. Pat. No. 9,585,455, issued Mar. 7, 2017, which is hereby incorporated by reference in its entirety. Such devices may advantageously incorporate a crown having one or more opening slits defining an access to a cavity within the crown for the insertion of a nail polish container. However, such devices are not useful for placement upon or securement to a work surface.

Another such activity is crafting of artistic appliqués and the like. An individual working on a crafting project may generate small pieces of waste or scrap material that must be removed from the work area. For example, cutting plotters, or computer controlled cutting machines, may leave behind small pieces of crafting substrate material that must be removed from the product, such as vinyl or another substrate material. In particular crafting activities, the crafting activity utilizes a cutting plotter, such as Cricut®, to cut vinyl, requiring "vinyl weeding" to be performed (i.e. removal of scrap pieces of vinyl from the work substrate). The removal of vinyl or generally another crafting substrate may therefore be termed "vinyl weeding". A device incorporating a crown having an opening slit defining an access to a cavity of the crown, such as devices disclosed in U.S. Pat. No. 9,585,455, may be useful for depositing small pieces or material or waste material using a pick, tweezer or other instrument. However, as with nail polish holder uses, such devices are not useful for placement upon or securement to a work surface.

For placement upon or securement to a work surface, such devices should have a base that secures to the work surface to prevent tipping and/or unintended movement. Advantageously, secure placement of a device upon a work surface removes the restriction that an individual must use the fingers of one of the hands to hold the device, thereby freeing both hands. Upon placement upon or securement to a work surface, the devices should resist displacement in the plane of the work surface (i.e. planar displacement) such that instruments, such as an applicator or tweezers, do not displace the device during use. The device should also be easily removable from the work surface without exerting significant effort (i.e. the device should be axially displaceable). Likewise, significant effort should not be required to secure the device to the work surface. Therefore, there is unmet need for such a device employing an appropriate base for placement on or securement to a work surface.

The present disclosure provides for devices having a base which secures to a work surface to prevent planar displacement while allowing axial displacement for removal from the work surface. Anchoring devices of this nature have been generally described previously, such as in U.S. Pat. No. 8,025,169, issued Sep. 27, 2011; U.S. Pat. No. 8,028,850, issued Oct. 4, 2011; U.S. Pat. No. 8,757,418, issued Jun. 24, 2014; and U.S. Pat. No. 9,814,332, issued Nov. 14, 2017, each of which are hereby incorporated by reference in their entireties. However, such bases have never been contemplated for use in nail polish holder or crafting devices. Provided herein are such devices advantageously incorporating such bases to provide devices axially securable to and removable from work surfaces, while being resistant to planar displacement when secured.

SUMMARY

Generally provided for are crafting scrap collection and nail polish holder devices and methods of use thereof. In an embodiment, provided for is a nail polish holder device comprising: a crown defining a cavity, the cavity being configured to secure a nail polish bottle; and a vented suction base coupled with the crown.

In some embodiments, the crown comprises a crown base, and sidewalls extending upwardly from the crown base, together defining the cavity.

In some embodiments, the crown further comprises a crown upper surface continuous from the sidewalls and opposite the crown base, the crown upper surface defining a top of the cavity and having an opening to the cavity.

In some embodiments, the vented suction base is hingedly coupled with the crown base.

In some embodiments, the crown base is coupled with a top portion of a hinge member, and wherein a bottom portion of the hinge member is coupled with the vented suction base.

In some embodiments, the top portion of the hinge member comprises first and second ridged protrusions opposed on first and second sides thereof.

In some embodiments, the crown base comprises two protrusions extended downwardly therefrom configured to sandwich the first and second sides of the hinge member, wherein the two protrusions of the crown base have acceptors to accept inserted first and second ridged protrusions of the hinge member, wherein the acceptors and ridged protrusions inserted therein interfere when the crown is rotated relative to the hinge member to define a plurality of hinge positions that minimize interference, and wherein the acceptors deform to allow movement between the plurality of hinge positions.

In some embodiments, the vented suction base is flexibly or releasably coupled with the crown base.

In some embodiments, the side walls define a frustroconical profile and have a first perimeter at the crown base smaller than a second perimeter at the upper surface In some embodiments, the opening is defined by a radially symmetrical grouping of one or more slits separated by one or more flaps formed as a part of the upper surface.

In some embodiments, the opening is defined by a radially symmetrical grouping of six slits separated by six flaps formed as a part of the upper surface.

In another embodiment, provided for is a scrap collection device comprising: a crown defining a cavity, the crown having a crown base and sidewalls extending upwardly therefrom to an upper crown surface, together defining the cavity; an opening having one or more slits disposed on the upper surface of the crown; and a vented suction base coupled with the crown.

In some embodiments, the vented suction base is hingedly coupled with the crown base.

In some embodiments, the crown base is coupled with a top portion of a hinge member, and wherein a bottom portion of the hinge member is coupled with the vented suction base.

In some embodiments, the top portion of the hinge member comprises first and second ridged protrusions opposed on first and second sides thereof.

In some embodiments, the crown base comprises two protrusions extended downwardly therefrom configured to sandwich the first and second sides of the hinge member, wherein the two protrusions of the crown base have acceptors to accept inserted first and second ridged protrusions of the hinge member, wherein the acceptors and ridged protrusions inserted therein interfere when the crown is rotated relative to the hinge member to define a plurality of hinge positions that minimize interference, and wherein the acceptors deform to allow movement between the plurality of hinge positions.

In some embodiments, the vented suction base is flexibly or releasably coupled with the crown base.

In some embodiments, the crown base, side walls, and crown top surface together define a spherical profile.

In some embodiments, the opening is defined by a radially symmetrical grouping of one or more slits separated by one or more flaps formed as a part of the upper surface.

In some embodiments, the opening is defined by a radially symmetrical grouping of six slits separated by six flaps formed as a part of the upper surface.

In a further embodiment, provided for is a method of painting the fingernails, comprising the steps of: securing a device to a work surface, said device having a crown defining a cavity, the cavity being configured to secure a nail polish bottle, and a vented suction base coupled with the crown, by securing the vented suction base to the work surface; placing a nail polish bottle into the cavity of the crown; and removing the applicator from the nail polish bottle and applying nail polish to the fingernails.

In some embodiments, the method further comprises the steps of: replacing the applicator to the nail polish bottle; and removing the device from the work surface once the fingernails have been painted by pulling the device away from the work surface in an axial direction substantially perpendicular to the plane defined by the work surface.

In a further embodiment, provided for is a method of collecting crafting scraps, comprising the steps of: securing a device to a work surface, said device having a crown defining a cavity, the crown having a crown base and sidewalls extending upwardly therefrom to an upper crown surface, together defining the cavity, an opening having one or more slits disposed on an upper surface of the crown, and a vented suction base coupled with the crown, by securing the vented suction base to the work surface; selecting a crafting scrap from a crafting product using an instrument having a tip for removing the scrap from the product; inserting the crafting scrap and instrument tip at least partially into the cavity of the crown through the opening thereof; depositing the scrap into the cavity of the crown; and removing the instrument tip from the cavity.

In some embodiments, depositing the scrap further comprises using a portion of one of the one or more the slits to mechanically remove the scrap from the instrument tip.

In some embodiments, the method is a weeding method and wherein the crafting scrap is selected from the group consisting of one or more of vinyl, heat transfer vinyl (HTV), cloth, paper, plastic, adhesive-backed material, tape, and masking material.

In some embodiments, the scrap is selected as vinyl and the method is a vinyl weeding method.

DETAILED DESCRIPTION

Devices

Figure 1:
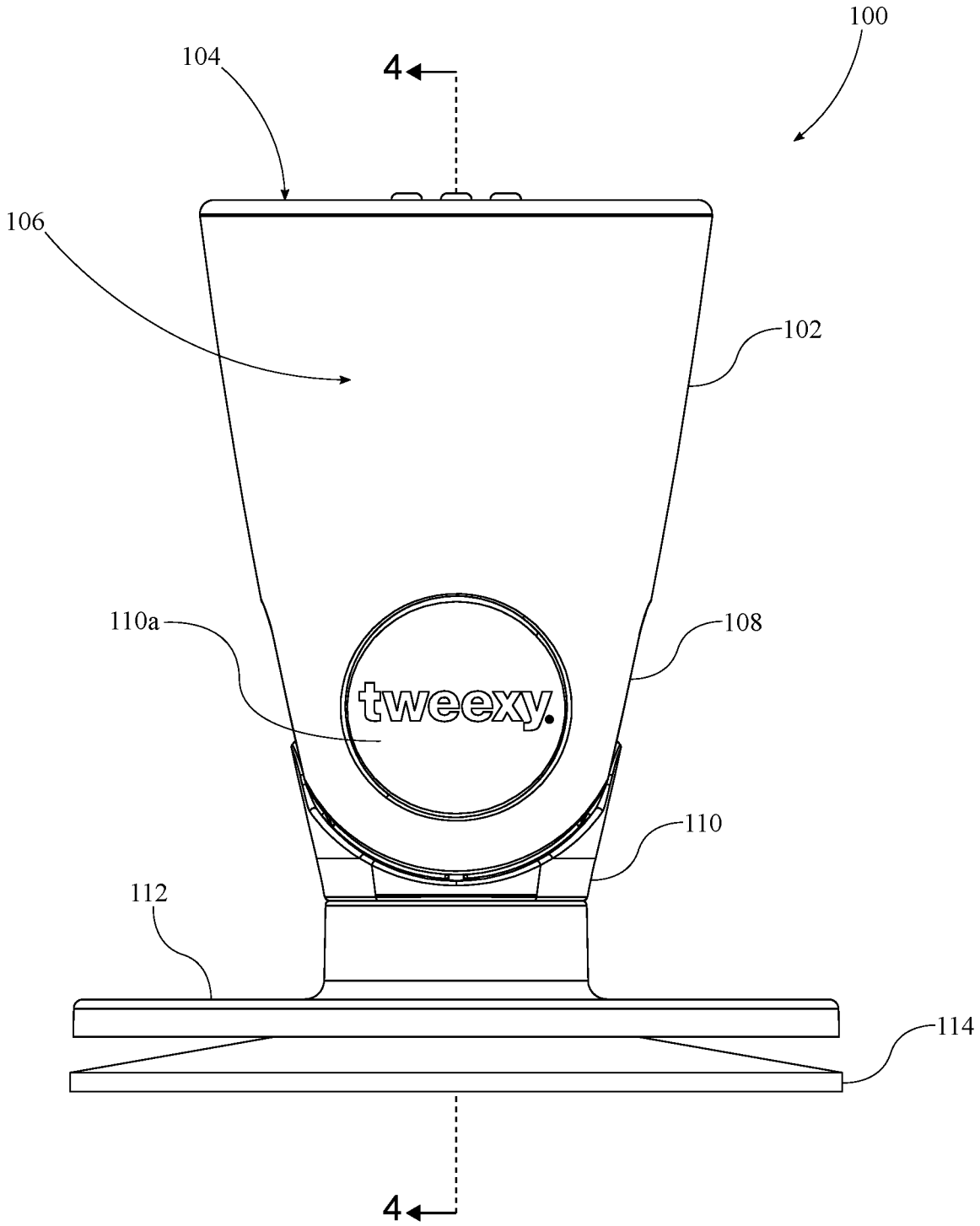
FIG. 1 depicts an exemplary embodiment of a device for holding a nail polish container and/or for collecting scraps from crafting projects.

The term "device" as used herein generally does not refer to a particular embodiment and may incorporate elements from any described embodiments. The "devices" are generally useful for holding nail polish bottles (i.e. as a nail polish holder) or for use in crafting, such as in removal of waste materials from a crafting substrate, and unless stated specifically, the "devices" described herein are useful for each of these purposes.

The bases contemplated herein are based upon anchoring technologies which provide for securement to a work surface to prevent planar displacement while allowing axial displacement for ease of securement to and removal from the work surface. Anchoring technologies of this nature have been generally described previously, such as in U.S. Pat. No. 8,025,169, issued Sep. 27, 2011; U.S. Pat. No. 8,028,850, issued Oct. 4, 2011; U.S. Pat. No. 8,757,418, issued Jun. 24, 2014; and U.S. Pat. No. 9,814,332, issued Nov. 14, 2017. In general, such technologies utilize a seal member configured to engage with a surface to form a substantially airtight seal therewith that defines a controlled pressure zone between the seal member and the surface. A communication port is provided which can be opened and closed by movement of a movable member, which is movable in reference to the surface and the seal member which is stationary on the surface. When the communication port is opened, the controlled pressure zone can be selectively vented or isolated in order to equilibrate the air pressure within the seal member with the atmospheric air pressure, thereby releasing the seal. Particularly, the movable member can be configured to move in an axial direction (perpendicular to the surface) in order to open and close the communication port, while movement in the plane of the surface is prevented by the seal member. Therefore, if such an anchor is used as a base in a device, the base would be configured to prevent planar displacement while allowing axial displacement for securement to and removal from the work surface.

Thus, the bases used herein may be termed "vented suction bases" and are distinguished from suction cups or bases employing suction cups. A suction cup, when placed upon a surface, requires significant force to expel air from the cup in order to create a low-pressure region within the cup compared to the higher atmospheric pressure outside of the cup. In order to remove the suction cup by pulling in an axial direction perpendicular to the plane of the surface, the user would need to overcome the forces created by the pressure difference. Suction cups typically do not seal well and may require re-sealing during use. A suction cup may have a pull tab on its perimeter for releasing the seal, however operation of such a release requires two-handed actuation—one hand to hold the device in a tilted position and to pull the device, and another hand to pull on the pull tab. Such two-handed actuation may be impossible in nail polish or crafting scenarios where one of the hands has wet nail polish or is required for another crafting purpose. A suction cup is therefore difficult to adhere to the work surface, and difficult to remove without jolting the device attached to the suction cup or without having both hands free. A suction cup used as a base would also be highly unstable and unpredictable.

As taught in the prior art, vented suction bases can take on different forms. In some embodiments, the vented suction bases have a communication port disposed at a central region of a seal member. In some embodiments, the communication port of the base is openable by lifting the device from the work surface and is closable by placing the device on the work surface. In some embodiments, the communication port remains closed when a device is placed on a work surface and remains closed if planar displacement in the plane of the work surface is attempted. In some embodiments, the movable member is every portion of the device which is not the seal member.

The vented suction bases generally comprise at least a seal member. The base may further comprise a base top portion that surrounds the seal member. In some embodiments, the base top portion is substantially coplanar with the work surface when in use. In some embodiments, the base top portion comprises a collar projecting upwardly therefrom configured to contain an upwardly projecting portion of the seal member and to engage with a portion of a hinge member.

In various alternative embodiments, a vented suction base may be substituted for a mechanically-actuated suction base in any device described herein. A mechanically-actuated suction base differs from ventable suction bases because ventable suction bases comprise a ventable communication channel within the seal member, whereas mechanically-actuated suction bases serve to induce or release a seal on the periphery of the suction or seal member thereof via a depressing member coupled with a lever or actuating member. Such mechanically-actuated suction bases are superior to standard suction cups because they provide a stronger seal and greater stability due to the depressing member that continuously presses down upon the seal member when the lever or actuating member is positioned to depress the seal via the depressing member. In exemplary embodiments, a lever or actuating member may extend to the periphery of the base for actuation of the depressing member. Mechanically-actuated suction bases may be configured for one-handed operation by placing the lever or actuating member in a position for actuation while the base is secured or removed from a work surface.

In reference to an exemplary embodiment depicted in FIG. 1, a device for crafting or holding a nail polish container is shown. The device 100 may comprise a crown 102, the crown having a crown upper surface 104, a crown base 108, and crown sidewalls 106 extending between the crown base 108 and the crown surface 104. The crown sidewalls 106 may extend radially upwardly from the crown base 108 in such a manner that the outer perimeter of the sidewalls 106 is smaller near the crown base 108 relative to the outer perimeter of the sidewalls 106 near the crown surface 104. The crown base 108 may be coupled with, connected to, or formed as a part of a hinge member 110. A portion of the hinge member 110 may be contained within a portion of the crown base 108 and one or more coupling portions, or couplers 110*a* of the hinge member 110 may be contained within an outer portion of the crown base 108 and may serve to secure the crown to the hinge member 110. It can be appreciated that any means of coupling the crown 102 to the hinge member are contemplated. The hinge member 110, coupled with the crown 102 on its top end, may advantageously interface with a vented suction base, and the suction member 114 thereof on its bottom end. A base top portion 112 may be coupled to each of the hinge member 110 and suction member 114. The suction member 114 is at the bottom of the device and, while in use, interfaces with a work surface.

The crown 102 and/or suction member 114 may be formed from a substantially pliable material. For example, the crown and/or suction member may be formed from silicone, thermo-plastic elastomers or thermo-plastic rubbers. The crown and/or suction member may be produced by any appropriate method, such as injection molding. Various parts, including the hinge member 110, base top portion 112, and/or couplers 110*a* and 110*b*, may be formed of a rigid plastic material.

Figure 2:
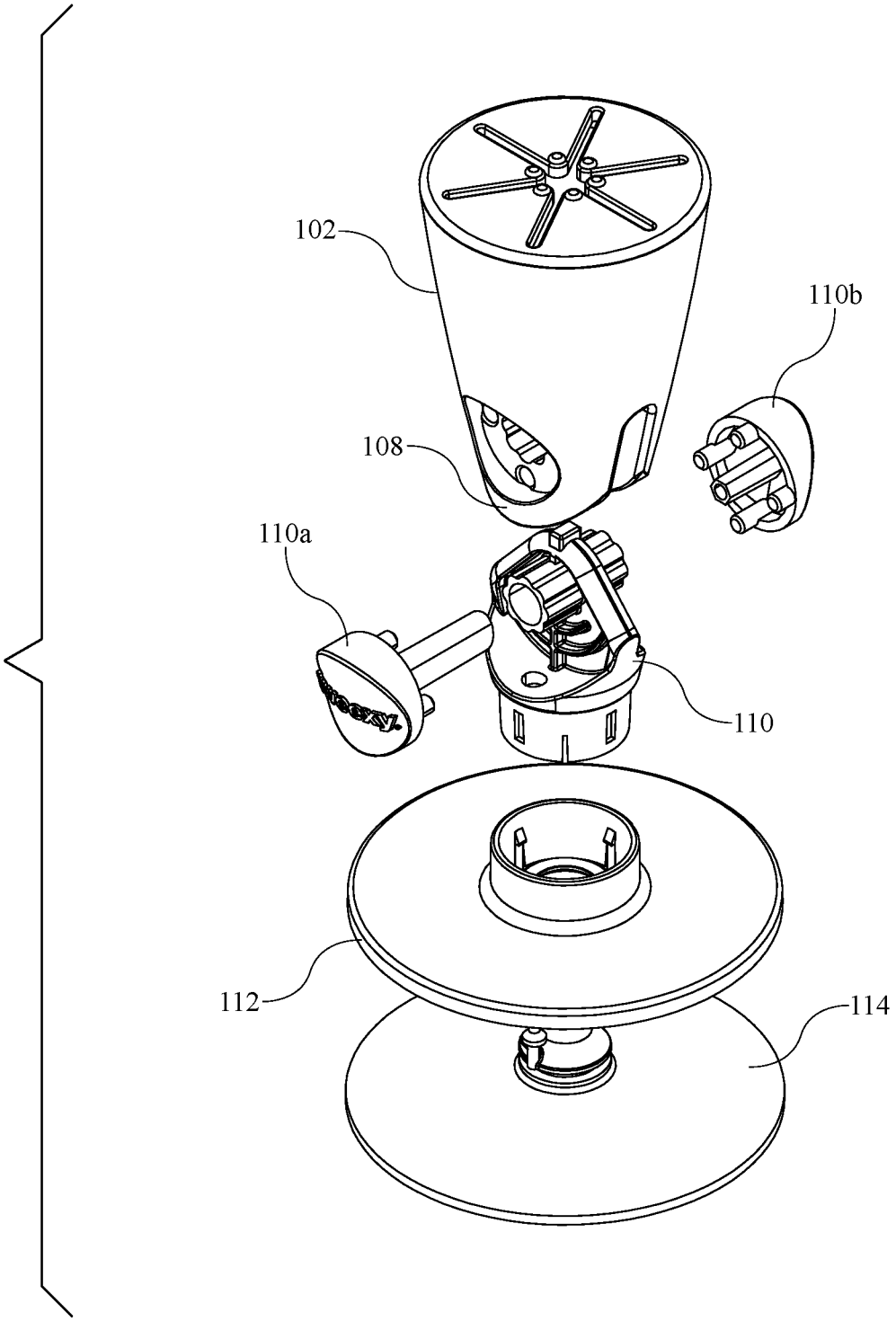
FIG. 2 is an exploded perspective view of the device of FIG. 1.

In reference to an exemplary embodiment depicted in FIG. 2, an exploded perspective view is shown. The crown 102 includes a crown base 108, which is a flexible member that may have a hinge member 110 coupled therewith. The hinge member 110 may comprise ridged protrusions that are configured and dimensioned to fit within similarly shaped ridged features, or acceptors, in the crown base 108. The ridged features of flexible crown base 108 may rotate against the ridged protrusions of the hinge member 110 to provide actuation into a plurality of positions. When the crown is actuated between the plurality of positions, the ridged features in the flexible crown base 108 may deform slightly to allow their movement past the ridged protrusions on the hinge member 110. The flexible crown base 108 is retained on the hinge member by couplers 110*a* and 110*b*. In an embodiment, the couplers 110*a* and 110*b* rotate with the crown 102 when the hinge is pivoted. The couplers 110*a* and 110*b* may comprise one or more protrusions that are inserted into depressions in the crown base 108 so that the crown 102 cannot be hingedly actuated without also rotating the couplers 110*a* and 110*b*. While an exemplary hinge structure is shown in FIG. 2, it can be appreciated that any hinge design is contemplated. The hinge member 110 may be coupled with a vented suction base. Particularly, hinge member 110 may be coupled with a base top portion 112 by insertion of the bottom of the hinge member 110 into a collar protruding from the base top portion 112. The suction member 114 may be inserted into the bottom of the hinge member 110 through the collar of the base top portion 112. The suction member 114 may have retaining features configured and dimensioned to be retained within the hinge member 110. In an alternative embodiment, the suction member 114 may have retaining features configured and dimensioned to be retained within the base top portion 112.

Figure 3A:
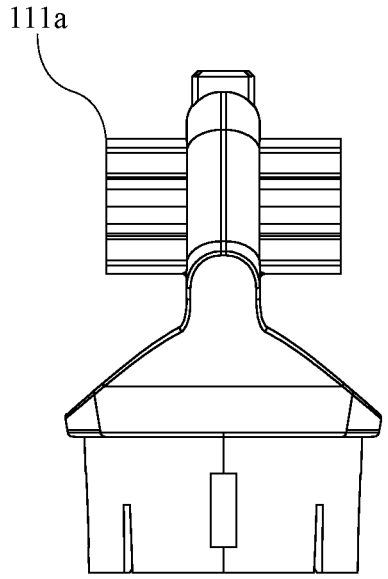
FIGS. 3A and 3B are side and perspective views of a hinge member.
Figure 3B:
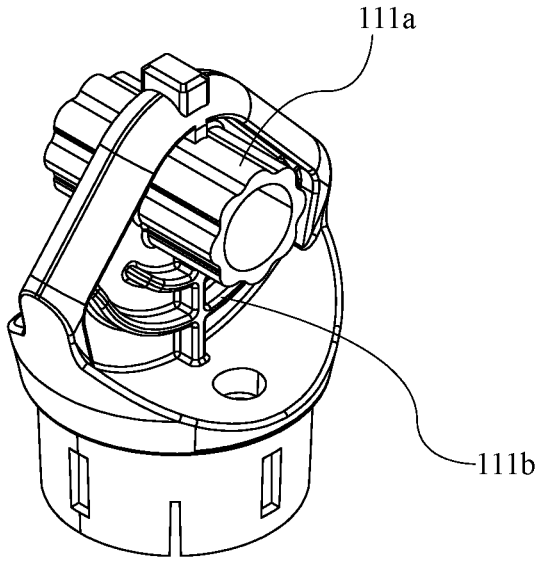

In reference to an embodiment depicted in FIGS. 3*a* and 3*b*, side and perspective views of an exemplary hinge member 110 are shown. FIG. 3*a* depicts a side view, where the base insertable into the base top portion 112 is shown, and the ridged protrusions 111*a*, which are configured and dimensioned to interfere with ridged features in the crown base 108, are shown. As seen in the perspective view in FIG. 3*b*, guide features 111*b* may be formed as a part of the hinge member 110 and may serve to guide the crown 102 as its base 108 is rotated against the hinge member 110. In an embodiment, the crown base 108 comprises protrusions that interfere with guides or stops 111*b* to guide and limit, respectively, the hinge motion of the crown 102 relative to the hinge member 110. The ridged protrusions 111*a* also may define a pin channel for insertion of the coupler 110*a*, which may have a pin that rotates within the pin channel of the hinge member. The couplers 110*a* and 110*b* are coupled through the pin channel to retain the crown base 108 in position on the hinge member 110. The vented suction base may advantageously, when secured to a surface, allow for one-handed movement between a plurality of positions without tipping.

Figure 4:
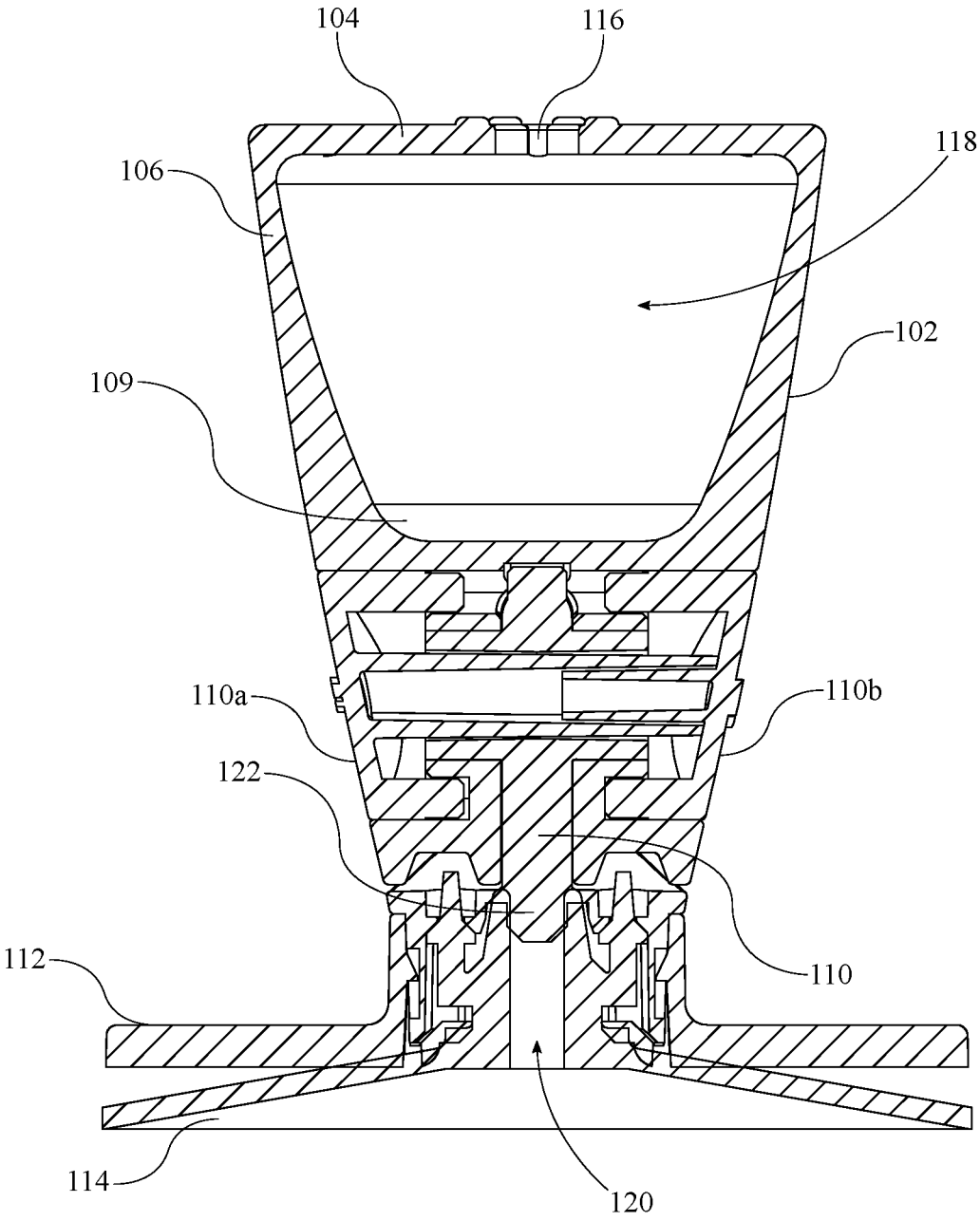
FIG. 4 is a cross-sectional view of the device of FIG. 1.

In reference to an exemplary embodiment depicted in FIG. 4, a cross-sectional view is depicted. In an exemplary embodiment, the device 100 may have a cavity 118 within the crown 102, the cavity being defined on its bottom by a cavity bottom 109, on its sides by sidewalls 106, and on its top by crown upper surface 104. An opening 116 disposed within the crown upper surface provides access to the cavity from the outside of the crown. In an alternative embodiment, the cavity bottom 109 may comprise semispherical protrusions, or protrusions of any other shape, to interface with the bottom of a nail polish container.

The term "opening" refers to the opening disposed on an upper portion of the crown or, in some embodiments, within a crown upper surface which allows for access to the cavity within the crown. The opening may take on various sizes, shapes, and configurations without departing from the scope of the disclosure. The opening may be defined by one or more slits separated by one or more flaps which are deformable to allow for a nail polish container or scrap material to be inserted into the cavity. The flaps may be separated from each other or from another portion of the crown top surface by slits. Therefore, an "opening" may be defined by one or more slits separated by one or more flaps formed as a part of the upper surface. In an alternative embodiment, an "opening" may not comprise flaps or slits. In an embodiment, a central aperture may be defined in-between the ends of the flaps in the center of the crown top surface. In another embodiment, no such central aperture may be defined. In a further alternative embodiment, the flaps may contain very little or no slit or gap and may interfere with one another along at least a portion of their dimension. In an embodiment, the flaps may further comprise one or more protrusions near their tip and near the central aperture to grip a nail polish container inserted into the cavity. It can be appreciated that any configuration of opening is contemplated.

In alternative scrap collection device embodiments, the crown may take on any shape or configuration. In embodiments for scrap collecting devices, the crown will necessarily have one or more slits and openings for accessing the cavity of the crown. In further scrap collection device embodiments, the opening or access to the crown cavity may comprise no flaps and may have a different shape such as square, circular, rectangular, star, or irregular shapes, with at least one slit disposed on the perimeter of the opening. In further scrap collection device embodiments, the slit, opening or access to the crown may be positioned in an alternative position instead of the crown top surface, such as on a sidewall.

In alternative embodiments, the nail polish holder devices may take on any shape or configuration. Any crown configured to hold the nail polish holder is contemplated. In an alternative embodiment, the crown may lack a top surface and instead be defined by a bottom and sidewalls with one or more features for retaining the nail polish bottle disposed on either or both of the cavity bottom or sidewalls. In an exemplary embodiment, the crown is shaped as an open-top cylinder with a plurality of fins extending from the sidewall of the cylinder to the center of the cavity. The fins may terminate before reaching the center of the cavity in order to define a space to accommodate various sizes of nail polish bottles wherein the fins deform to securely grasp the bottle. The fins may extend perpendicularly from the sidewall or may each be placed at an angle in order to each deform circularly in a predictable manner once the nail polish bottle is placed in the space. Alternatives to fins are contemplated, such as a plurality of finger-like projections, or any other type of projection useful for retaining the nail polish bottle. In a further alternative nail polish holder embodiments, the crown may comprise a top surface as well as internal projection features in the cavity for retaining the nail polish bottle. In a further alternative embodiment, the cavity may comprise inserted or attached foam or other deformable material for securing the nail polish bottle. In a further alternative embodiment, the cavity or crown may comprise a spring-loaded or manually actuated clamp or other mechanism for retaining the nail polish bottle. In a further alternative embodiment, the crown may itself be a clamp or other securement mechanism. In a further alternative embodiment, the crown may be any structure which retains the nail polish bottle by friction against any portion of the crown and the nail polish bottle. A crown or cavity may be described as being configured to secure a nail polish bottle, and it can be appreciated that any structure described herein is contemplated. A crown or cavity being configured to secure a nail polish bottle may retain a nail polish bottle by being configured and dimensioned to apply friction against any portion of the nail polish bottle when inserted into the cavity.

Still in reference to FIG. 4, the crown, and particularly the crown base, is secured against the hinge member 110 by couplers 110*a* and 110*b*. The hinge member 110 may be inserted into a protruding collar of the base top portion 112. As described in the foregoing, vented suction bases typically comprise a seal or seal feature, as part of the movable portion of the device, to seal against a communication channel in a stationary suction member. The hinge member 110, being contained within a movable portion of the device, may comprise a seal or seal feature 112 which is configured to be seated within a communication channel 120 of the suction member 114. When the device is placed on a work surface, air from the suction member 114 is displaced such that the air pressure within the suction member 114 and communication channel 120, sealed at its top by seal 122, is lower than the atmospheric pressure. The device thereby resists displacement in a direction defined by the plane of the work surface. Advantageously, when the device is lifted in an axial direction perpendicular to the work surface (i.e. the device is lifted upwardly from the work surface), the seal 112 is released from the communication channel 120 resulting in equilibration between the pressure within the communication channel 120 and suction member 114. As a result, lifting in the axial direction results in the suction member being vented such that the device can be easily lifted with minimal effort.

While a hinge is depicted as the member that couples the crown to the vented suction base, further crown couplers are contemplated. In an embodiment, the crown may be releasably attached to the vented suction base, such as by way of a magnetic, screw-type, rotatably locking, or other mechanism. In an embodiment, the crown may be attached to the vented suction base by a flexible member that can maintain a plurality of positions. In an embodiment, the crown may snap onto a hinge or other member using a hole in the bottom of the flexible crown which may further serve as a scrap or waste removal hole.

Figure 5A:
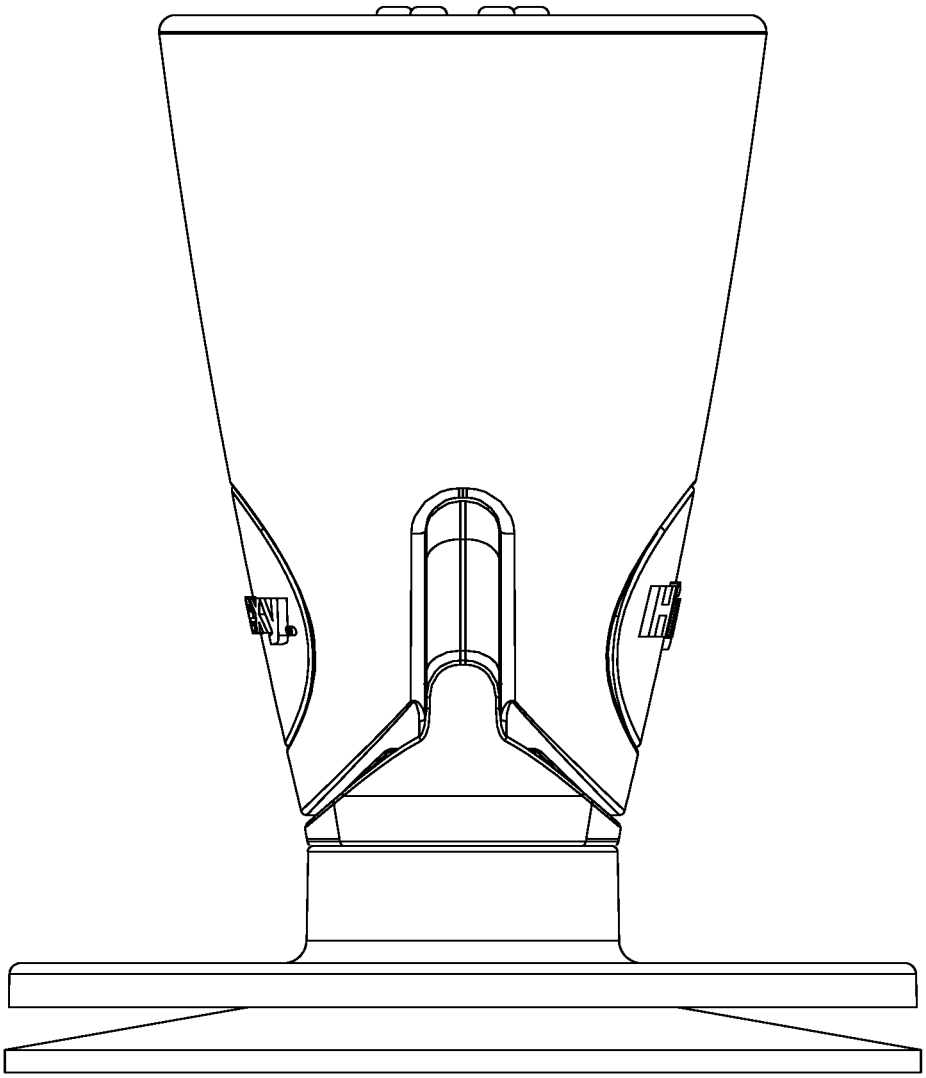
FIG. 5A is a first side view of an exemplary embodiment.
Figure 5B:
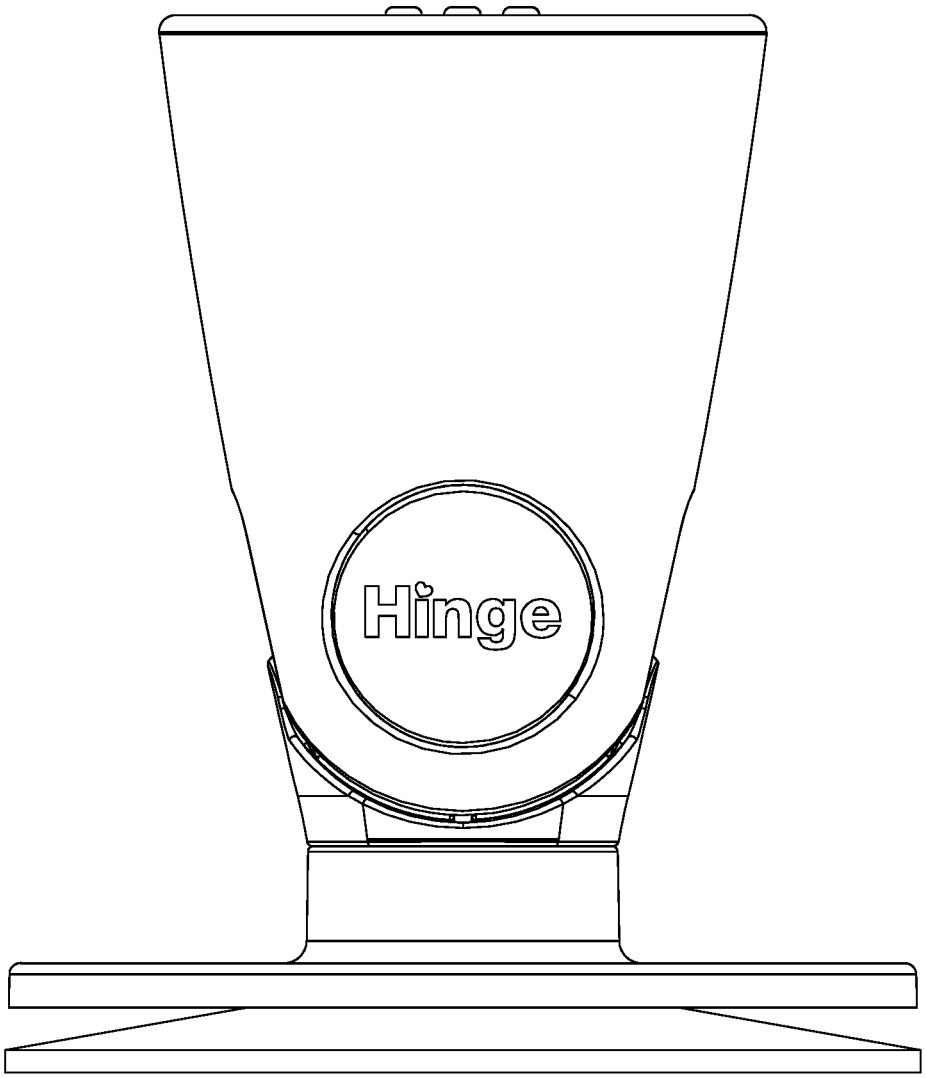
FIG. 5B is a front view of an exemplary embodiment.
Figure 5C:
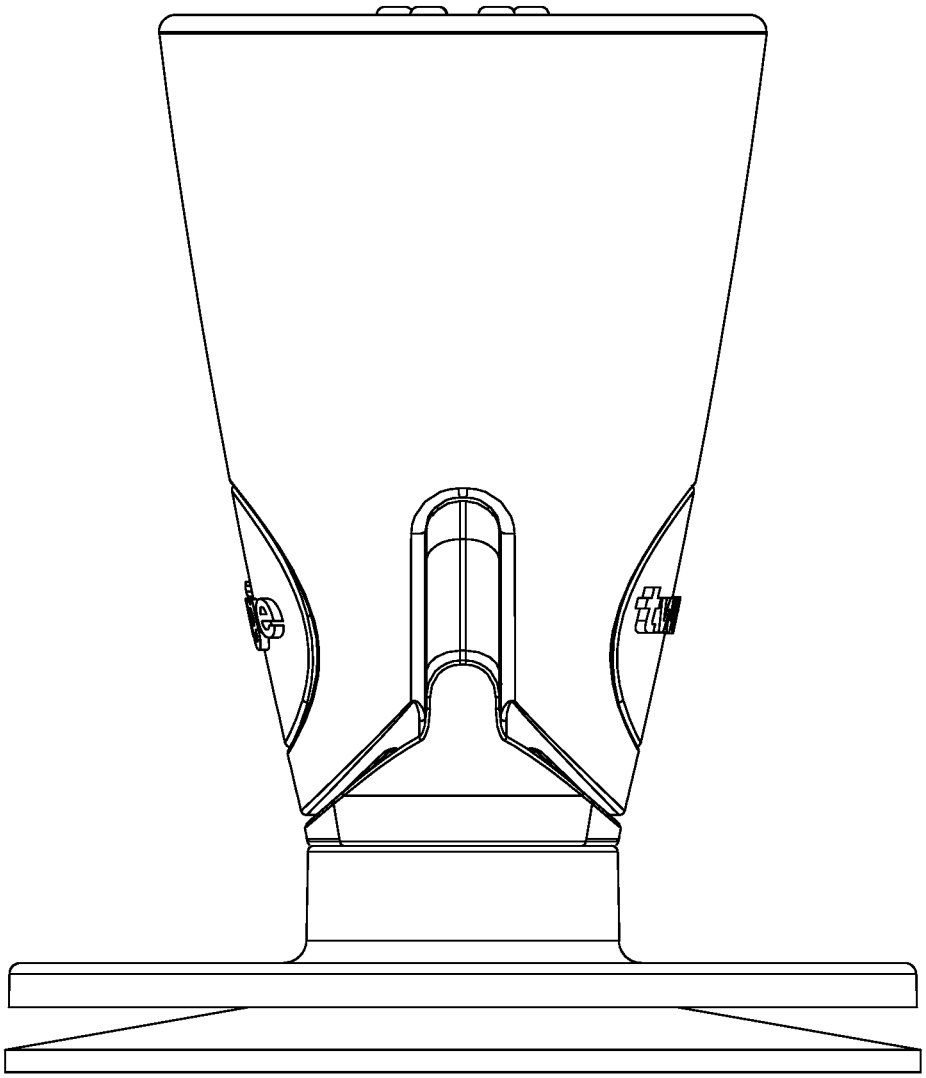
FIG. 5C is a second side view of an exemplary embodiment.
Figure 5D:
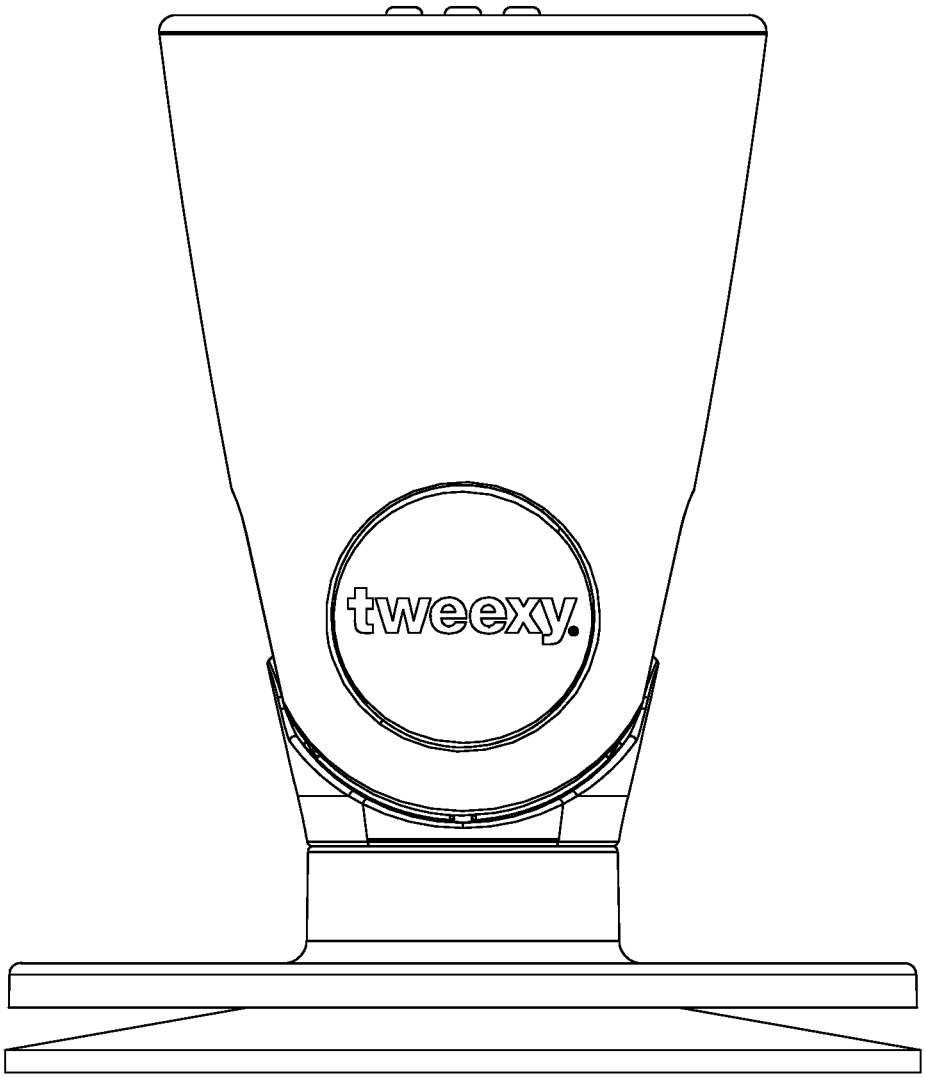
FIG. 5D is a rear view of an exemplary embodiment.
Figure 5E:
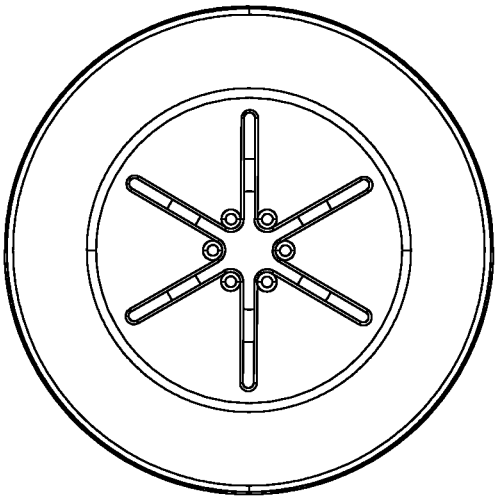
FIG. 5E is a top view of an exemplary embodiment.
Figure 5F:
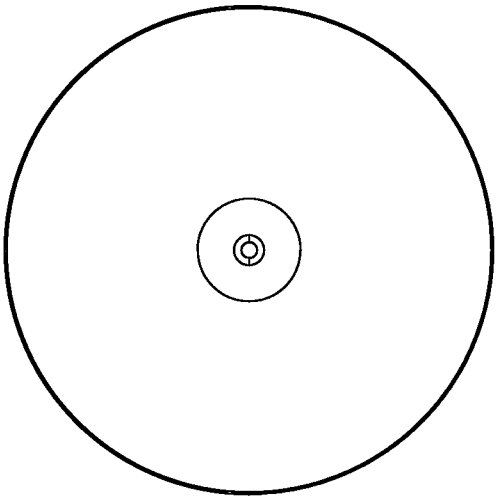
FIG. 5F is a bottom view of an exemplary embodiment.
Figure 6A:
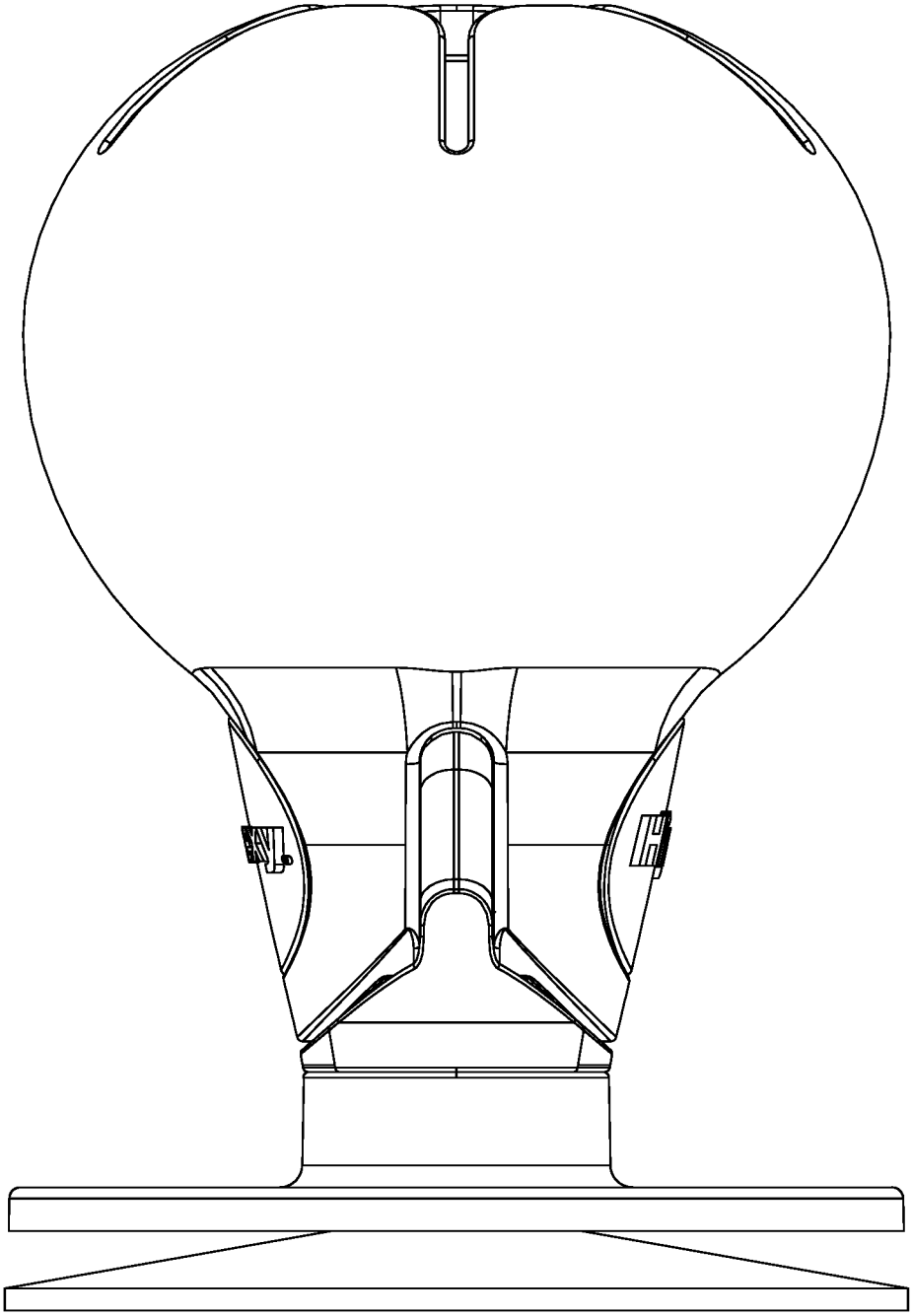
FIG. 6A is a first side view of a further exemplary embodiment.
Figure 6B:
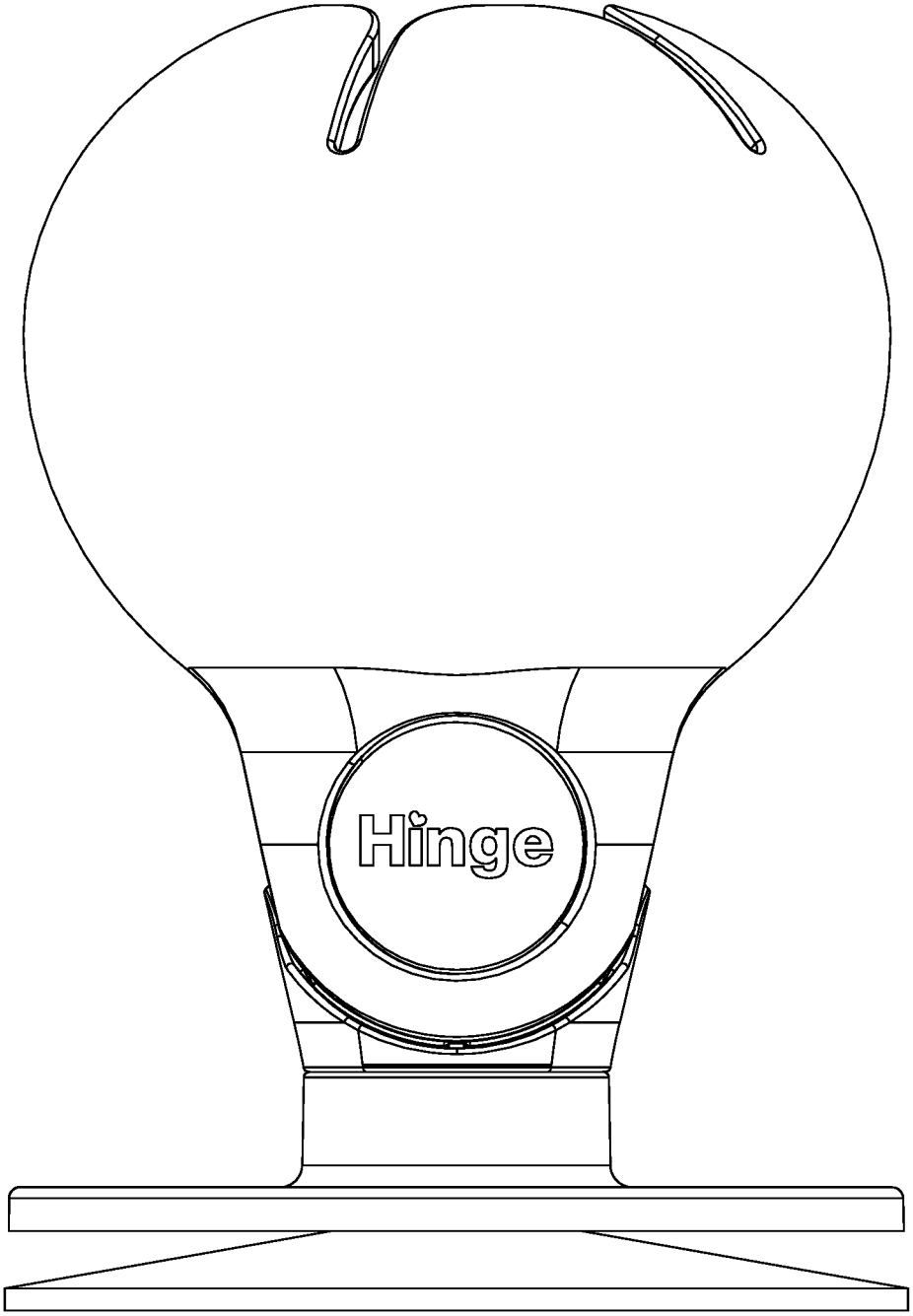
FIG. 6B is a front view of an exemplary embodiment.
Figure 6C:
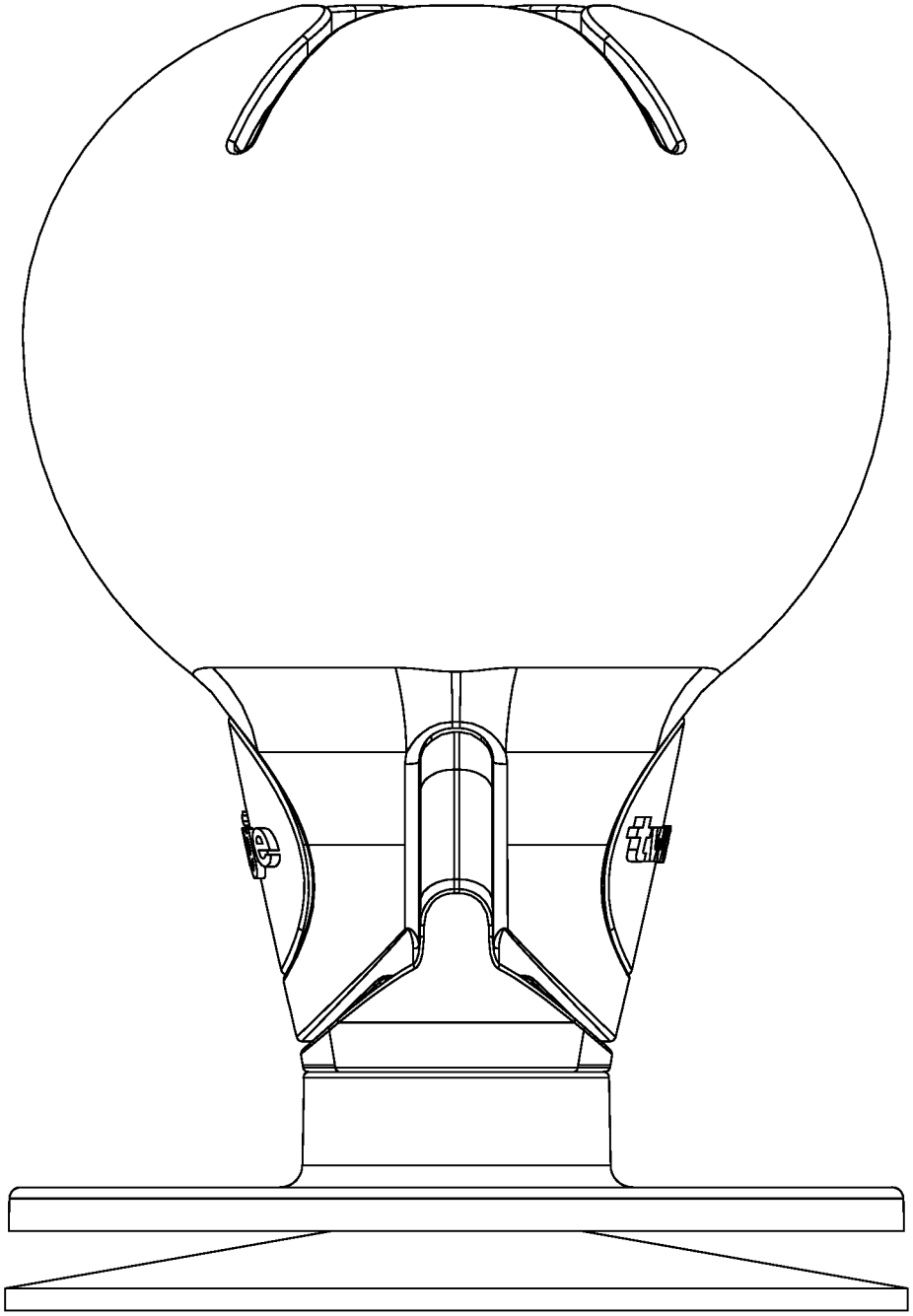
FIG. 6C is a second side view of an exemplary embodiment.
Figure 6D:
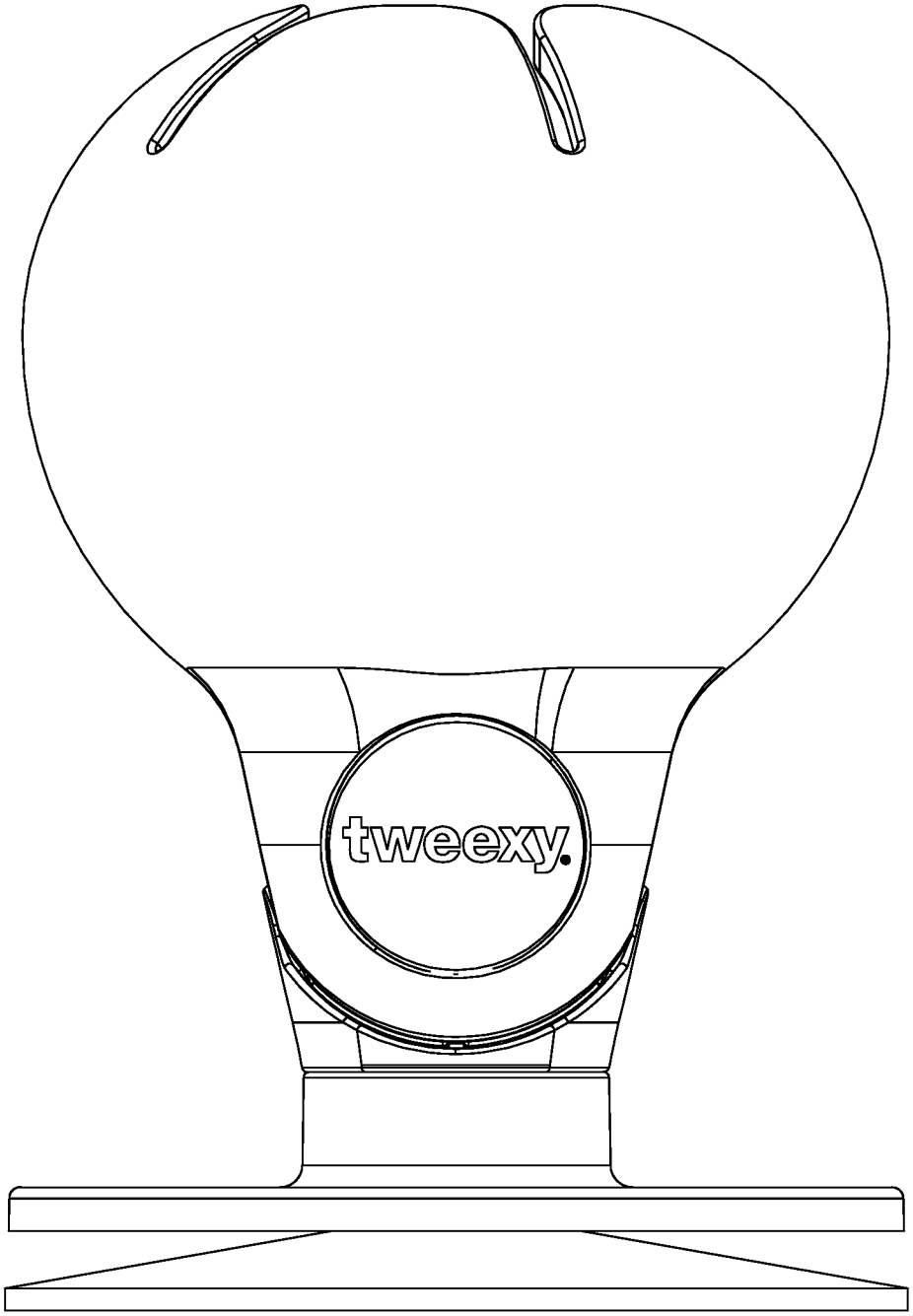
FIG. 6D is a rear view of an exemplary embodiment.
Figure 6E:
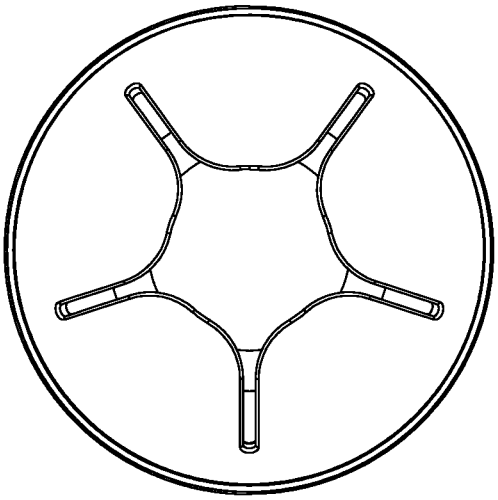
FIG. 6E is a top view of an exemplary embodiment.
Figure 6F:
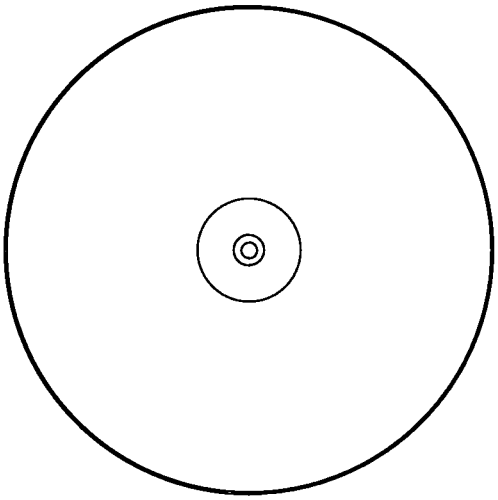
FIG. 6F is a bottom view of an exemplary embodiment.

FIGS. 5A-5F depict an exemplary embodiment shown in the two side views (FIGS. 5A and 5C), a front view (FIG. 5B), a rear view (FIG. 5D), a top view (FIG. 5E), a bottom view (FIG. 5F). The particular embodiment depicted has an overall frustro-conical shape tapering from a larger diameter or perimeter at the top of the crown to a smaller diameter or perimeter at the base of the crown. As seen in the top view (FIG. 5E), the top comprises an opening defined by a plurality of slits defining flaps projecting toward the center of the crown. The flaps are separated by the slits on their sides and define larger aperture in the center of the crown top surface. In the particular embodiment depicted six slits and flaps are arranged in a radially symmetric manner. The cavity of the crown is accessible through the aperture and/or slits in-between the flaps. The crown, including the flaps, is constructed from a substantially pliable material so that the flaps may be deformed to accommodate an object larger than the aperture. The flaps further each contain a protrusion to grip an inserted nail polish container. The bottom view shows the vented suction base thereof. The crown may be positioned in a plurality of such hinged positions during use to provide optimal positioning.

FIGS. 6A-6F depict an exemplary embodiment shown in the two side views (FIGS. 6A and 6C), a front view (FIG. 6B), a rear view (FIG. 6D), a top view (FIG. 6E), and a bottom view (FIG. 6F) The particular embodiment depicted has an overall spherical shape of the crown. As can be seen in the top view of FIG. 6E, the top comprises an opening defined by a plurality of slits defining flaps projecting toward the center of the crown. The flaps are separated by the slits on their sides and define a larger aperture in the center of the crown top surface. In the particular embodiment depicted, six slits and flaps are arranged in a radially symmetric manner. The cavity of the crown is accessible through the aperture and/or slits inbetween the flaps. The crown, including the flaps, is constructed from a substantially pliable material so that the flaps may be deformed to accommodate an object larger than the aperture. The bottom view shows the vented suction base thereof. The crown may be positioned in a plurality of such hinged positions during use to provide optimal positioning.

Figure 7B:
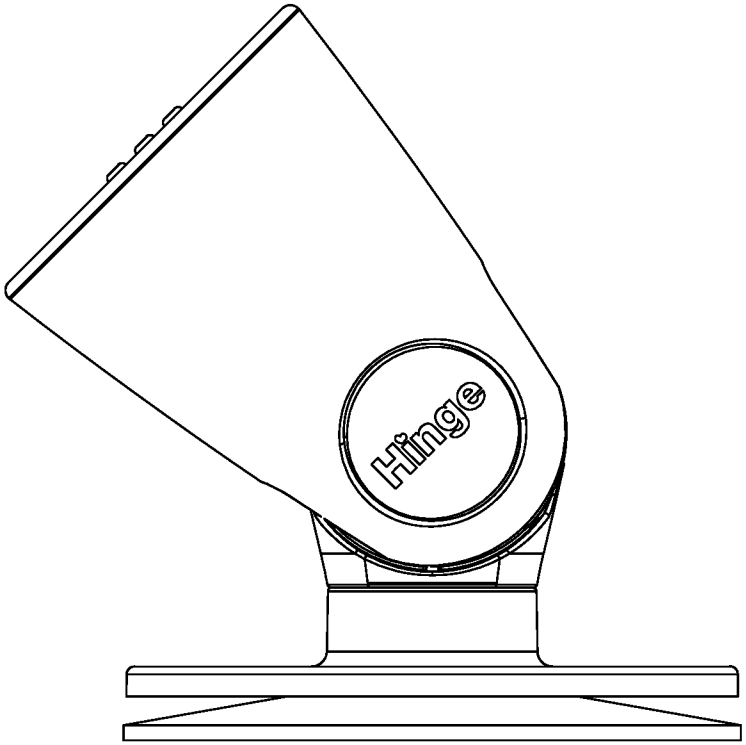
FIG. 7B shows an exemplary embodiment in one of a plurality of hinged positions.
Figure 7A:
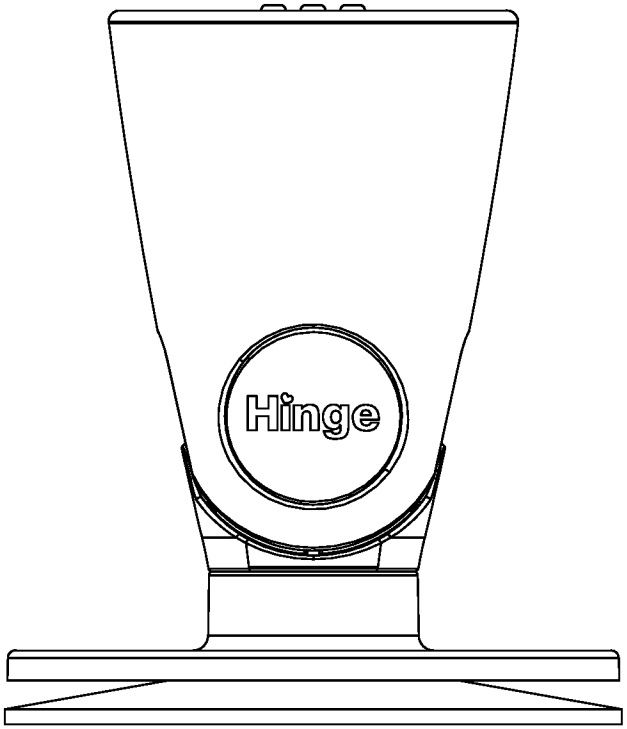
FIG. 7A shows an exemplary embodiment in a vertical position.

FIGS. 7A and 7B depict an exemplary embodiment in vertical (FIG. 7A) and hinged (FIG. 7B) positions. Beginning from the vertical position depicted in FIG. 7A, the crown may be hinged in either direction with respect to the vented suction base and hinge member. In some embodiments, the crown may be positioned in a plurality of positions in-between the vertical position and the fully hinged position, in either direction. The fully hinged position may be defined by interference between the hinge member and the crown base which prevents the crown from being hinged beyond the fully hinged position. In some embodiments, the crown may be continuously positioned between the vertical position and the fully hinged position, in either direction.

In an embodiment, the crown is configured for accepting a nail polish container. The crown may be configured to accommodate a wide range of nail polish containers of present in the market that have various shapes of base, sizes, brands, capacities, base dimensions, heights, widths, and angle of bottle. Exemplary base shapes of nail polish containers that can be accommodated by the crown include circular, square, quarter moon, oval, rectangular, triangular, and other jewel shapes. Exemplary sizes of nail polish containers that can be accommodated by the crown are mini, standard, and medium. Exemplary brands of nail polish containers that can be accommodated by the crown are Ulta, OPI, China Glaze, Nails Inc., PIXEL, Sally Beauty, Cover Girl, Sally Hansen, CND, Mineral Fusion, RUSH, ASP, Sephora, Revlon, Maybelline, NYC, Orly, Finger Paints, gelish, Nina, INM, Sinful Colors, Beauty Secrets, Cinapro, Seche, American Classics, Beauty Secrets, Nail Savvy, and FUSE. Exemplary capacities of nail polish containers that can be accommodated by the crown include 0.17-0.60 Fl. Oz. The foregoing are illustrative only. The flexible design of the crown can be configured so as to accommodate any base shape, capacity, shape, size, brand, base dimension, height, width, and angle of bottle.

In an embodiment, the crown is preferably configured so as to facilitate the retention of nail polish containers. For instance, contoured and tapered cavity interior shapes accommodate various bottle circumferences, heights and shapes. A number of slits in the crown may be employed as an opening to the crown cavity, the slits defining a plurality of flaps. In certain embodiments, six slits and flaps are employed. The flaps in the crown may allow the bottle to be tipped as the volume of nail polish diminishes or to be tipped for on-the-go hand positions. In certain embodiments, the top of the crown or flaps are textured to add additional grip that helps hold the bottle in place. Similarly, the interior base of the crown cavity may or may not be textured to offer resistance to the nail polish bottle when opening.

In another embodiment, the crown is configured to contain and collect scrap materials produced during crafting, for example vinyl scrap material removed by vinyl weeding. The aperture size, the number, shape, and/or size of flaps, as well as the size of the slits inbetween the flaps may be configured for different scrap materials or crafting purposes. The aperture may be large enough to accept a scrap material, potentially with deformation of the flexible flaps, while the slits may be too narrow to allow the scrap material to pass therethrough. In this manner, the user may insert a scrap through the aperture using a pick, tweezer or other instrument, and then place the instrument in a position such that its removal from the cavity results in the scrap interfering with one or more flaps in order to remove the scrap from the instrument. In an embodiment, the inner portion of the flaps have a textured surface to assist in capturing scraps.

The disclosed devices may be manufactured in a single color, with multiple colors, or a pattern. Various applied textures, including embossing and debossing, as well as smooth surfaces may be employed. Accessories such as a leash, a hanging device, a key chain clip or other custom-style elements may be included. In certain embodiments, scents are infused in the holder's material.

Methods of Use

Two exemplary methods of use are provided for herein. The first is a method of using the devices as described herein to hold a nail polish container, and further to hold a nail polish container while painting the fingernails. The second is a method of collecting scrap materials or other crafting materials for disposal.

In an embodiment, a method of holding a nail polish container is provided for. A device according to FIGS. 5A-5F may be particularly suited for certain methods of holding a nail polish container. A user may first select a work surface or other surface for placing the device upon. The work surface may be flat, angled, or, in some embodiments, near vertical. Optionally, the surface may be cleared of debris or cleaned. The vented suction base of the device is then placed upon the surface. Optionally, additional force may be applied to further seal the vented suction base to the surface. With the vented suction base of the device secured to the surface, a nail polish container may be inserted into the cavity of the crown of the device by displacing the flaps of the opening and pressing the nail polish container into the cavity. Alternatively, the nail polish container may be inserted prior to securing the vented suction base to the surface. The cap of the nail polish container, typically comprising an applicator, may be removed at any time. The position of the crown relative to the hinge member and vented suction base may also be adjusted at any time prior to or after placement on the surface to adjust the orientation of the nail polish bottle during use. With the nail polish bottle secured and optimally positioned via the hinge, the user may then use the applicator to apply nail polish while the nail polish bottle is contained within the crown of the holder. Advantageously, the device will not be accidentally displaced while the applicator is inserted because the vented suction base prevents undesired displacement in the plane of the surface. When finished, the user may remove the device from the surface by pulling the device away from the surface such that the vented suction base disengages from the surface. Advantageously, the user may remove the device easily with one hand and without significant effort due to the vented suction base being axially displaceable. It can be appreciated that the method steps can be performed in various orders and repeated as needed, for instance if two or more nail polish types are applied and the first container is replaced with a second container.

In another embodiment, provided for are methods of use for scrap collection. A device according to FIGS. 6A-6F may be particularly suited for certain methods of scrap collection. A user may first select a work surface or other surface for placing the device upon. The work surface may be flat, angled, or, in some embodiments, near vertical. Optionally, the surface may be cleared of debris or cleaned. The vented suction base of the device is then placed upon the surface. Optionally, additional force may be applied to further seal the vented suction base to the surface. Before or after placing the device on the surface, the device may be positioned in any one of a plurality hinged positions to optimize the position of the crown and opening thereof. Once the device has been positioned on the work surface in an optimized position, it may be used for scrap collection. A user may use tweezers or another instrument to pick up one or more pieces of scrap from a crafting project. In some embodiments, a hook-shaped or angled pick with a sharp or bladed end may be used as an instrument to remove the crafting scrap from the crafting product. The user may then insert the piece of scrap into the aperture of the device crown such that the scrap is contained within the cavity of the crown. The user may then, in the case of a tweezer, release the grasping mechanism on the tweezers to release the scrap. In some uses, the scrap may adhere to the tweezers or other instrument due to static forces, and if so, the user may position the tweezers or instrument, while inserted into the cavity, such that it is located in a slit between the flaps of the crown. With the tweezers or instrument positioned, the tweezers or instrument may then be withdrawn from the cavity such that the scrap material is removed from the tweezers or other instrument. This procedure can be repeated any number of times until the cavity is full with scrap material. Once full, the user may remove the device from the surface by pulling the device away from the surface such that the vented suction base disengages from the surface. The user may then empty the device into a trash receptable. Advantageously, the user may remove the device easily with one hand and without significant effort due to the vented suction base being axially displaceable. It can be appreciated that the method steps can be performed in various orders and repeated as needed. A device according to FIGS. 6A-6F may be particularly suited for vinyl weeding applications.

The crafting scrap may be any material which is not desired on the crafting product. The crafting scrap may be one or more of vinyl, heat transfer vinyl (HTV), cloth, paper, plastic, adhesive-backed material, tape, and masking material. The removal of the crafting scrap may be termed "weeding", such as "vinyl weeding", "cloth weeding", etc. The recitation of a particular type of weeding (i.e. "vinyl weeding") is non-limiting and it can be appreciated that the devices and methods are useful for weeding any crafting scrap. Likewise, the recitation of "weeding" generally is intended to compass weeding or removal of any type of crafting scrap from the crafting product.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed is:

1. A nail polish holder device comprising:

a crown as a continuous body of material defining a cavity with a continuous concave surface, the cavity being configured to secure a nail polish bottle, and a central lengthwise axis of the nail polish bottle being aligned coincident with a central lengthwise axis of the cavity;

a vented suction base being hingedly coupled with the crown, the crown comprises a crown upper base, a crown lower base, and a crown annular sidewall;

the crown annular sidewall extending upwardly from the crown lower base, together defining the cavity;

the crown upper base being continuous from the crown annular sidewall and opposite the crown lower base;

the crown upper base defining a top of the cavity and having an opening to the cavity;

the opening being defined by a radially symmetrical grouping of two or more slits separated by two or more flaps formed as a part of the crown upper base;

the crown lower base being coupled with a top portion of a hinge member;

a bottom portion of the hinge member being coupled with the vented suction base;

the top portion of the hinge member comprising first and second convex ridged protrusions opposed on first and second sides thereof;

the crown lower base comprising two protrusions extended downwardly therefrom configured to sandwich the first and second sides of the hinge member;

the two protrusions of the crown lower base having concave acceptors that receive the first and second convex ridged protrusions of the hinge member;

the concave acceptors and convex ridged protrusions inserted therein being configured to interfere when the crown is rotated relative to the hinge member to define a plurality of hinge positions that minimize interference;

the concave acceptors being configured to deform to allow movement between the plurality of hinge positions; and each of the plurality of hinge positions being less than 90 degrees of rotation.

2. The device of claim 1 wherein the side walls define a frustro-conical profile and have a first perimeter at the crown base smaller than a second perimeter at the upper surface.

3. The device of claim 1, wherein the symmetrical grouping includes six slits separated by six flaps.

* * * * *